US005947387A

United States Patent [19]

Zink et al.

[11] Patent Number: 5,947,387

[45] Date of Patent: Sep. 7, 1999

[54] ADJUSTABLE ROTATING WATER JET TOOL FOR THREE DIMENSIONAL CLEANING

[75] Inventors: Gerald P. Zink; John E. Wolgamott; Douglas E. Wright, all of Durango, Colo.

[73] Assignee: Stoneage Inc., Durango, Colo.

[21] Appl. No.: 08/702,319

[22] Filed: Aug. 23, 1996

[51] Int. Cl.[6] ..... B05B 3/00

[52] U.S. Cl. ..... 239/227; 239/252; 239/258

[58] Field of Search ..... 239/225.1, 227, 239/251, 252, 253, 258

[56] References Cited

U.S. PATENT DOCUMENTS

| | | | |
|---|---|---|---|
| 2,335,281 | 11/1943 | Jepson | 239/253 |
| 2,865,672 | 12/1958 | Guinard | 239/252 |
| 3,074,098 | 1/1963 | Downing | 239/258 |
| 3,231,199 | 1/1966 | Mattson | 239/253 |
| 3,255,970 | 6/1966 | Saad | 239/253 |
| 3,326,468 | 6/1967 | Bristow et al. | 239/252 |
| 3,931,930 | 1/1976 | Waldrum | 239/253 |
| 5,169,069 | 12/1992 | Rucker et al. | 239/227 |
| 5,452,853 | 9/1995 | Shook et al. | 239/227 |

*Primary Examiner*—Andres Kashnikow
*Assistant Examiner*—Lisa Ann Douglas
*Attorney, Agent, or Firm*—Maxwell C. Freudenberg; Kenton L. Freudenberg

[57] ABSTRACT

A rotatable high pressure tool for cleaning hollow objects by forcing a high pressure fluid such as water from nozzles to create cleaning jet streams and use jet reaction at the tool to continually change the direction of the jet nozzles about a longitudinal axis of the tool while the jets are carried by a cross body rotating about an axis essentially perpendicular to the longitudinal axis. Each of the nozzles provides the same amount of reaction torque to rotate the cross body about its axis. This torque is selectively adjustable at the tool before use by similarly releasing, changing and reclamping the orientation of all nozzles relative to the cross body and by changing the discharge diameters of uniformly sized nozzle tips. The adjustable nozzles are interconnected by gearing so that the changes in orientation of all nozzles during adjustment will be the same. The rotational speed of the nozzles and main body during use are further controlled by being subjected to a torque drag of a viscous liquid between two closely spaced surfaces.

21 Claims, 9 Drawing Sheets

| PRESSURE, PSI \ FLOW RATE, GPM | 15 | 20 | 25 | 30 | 40 | 50 | 60 | 80 |
|---|---|---|---|---|---|---|---|---|
| 12000 | .047Ø<br>9.0 | .054Ø<br>5.0 | .062Ø<br>4.0 | .068Ø<br>3.0 | .078Ø<br>2.0 | .089Ø<br>1.5 | .094Ø<br>1.5 | .109Ø<br>1.0 |
| 10000 | .054Ø<br>6.0 | .062Ø<br>4.5 | .068Ø<br>3.5 | .073Ø<br>3.0 | .089Ø<br>2.0 | .094Ø<br>2.0 | .109Ø<br>1.5 | .125Ø<br>1.0 |
| 8000 | .054Ø<br>9.0 | .062Ø<br>5.0 | .073Ø<br>3.5 | .078Ø<br>3.0 | .089Ø<br>2.5 | .094Ø<br>2.0 | .109Ø<br>1.5 | .125Ø<br>1.0 |
| 6000 | .062Ø<br>7.0 | .068Ø<br>5.5 | .078Ø<br>5.5 | .089Ø<br>3.0 | .094Ø<br>2.5 | .109Ø<br>2.0 | .125Ø<br>1.5 | .140Ø<br>1.0 |
| 4000 | .068Ø<br>9.0 | .078Ø<br>7.0 | .047Ø<br>5.5 | .089Ø<br>4.0 | .109Ø<br>2.5 | .125Ø<br>2.0 | .140Ø<br>1.5 | .156Ø<br>1.0 |
| 2000 | .078Ø<br>9.0 | .089Ø<br>9.0 | .094Ø<br>9.0 | .109Ø<br>5.0 | .125Ø<br>3.5 | .140Ø<br>3.0 | .156Ø<br>2.0 | .180Ø<br>1.5 |

.089Ø
9.0

NOZZLE DIAMETER FOR PRESSURE AND FLOW

BANJO NIPPLE SETTING FOR 20 TO 30 RPM

Fig. 10

ADJUSTABLE ROTATING WATER JET TOOL FOR THREE DIMENSIONAL CLEANING

BACKGROUND OF THE INVENTION

Although it is well known to insert fluid jet nozzles into hollow structures and manipulate them to clean interior wall surfaces, it is difficult to both provide high intensity fluid streams and assure that they will be moved to uniformly scan and clean all interior surfaces, particularly when the surfaces are not easily observable during the cleaning process and when adjustability of the device prior to use may be desirable to accommodate a wide range of combinations of fluid volumes and pressures.

In some prior art high pressure nozzle systems the nozzles have been rotatable about two different axes to produce a 3-D spray pattern but the nozzles were not adjustable in their angular positions relative to the nozzle support to simultaneously adjust the effective reactive force from each nozzle. Some prior 3-D pattern spray tools provided nozzles which had inlet ends of the nozzle elements which pointed directly at the axis around which they rotated and thus required a bend in the nozzle element to achieve an offset of the discharge end of the nozzle element to produce rotation of the nozzle support or such nozzle rotation was produced by motive means different than from reaction at the jet discharges. In still other 3-D high pressure systems oppositely pointing parallel nozzles were fixed in a rotatable manifold block with no angular adjustment of the nozzles to change the reactive force produced.

SUMMARY OF THE INVENTION

This invention relates to a cleaning tool having a nozzle apparatus movable in response to jet reaction forces of cleaning jet streams of fluid to provide a three-dimensional scanning pattern of the jet streams to clean the interior wall surfaces of hollow structures such as vessels, tanks or tubes by the impingement on the walls of the jet streams under high pressure for cutting and removing deposits or coatings on the wall surfaces. Nozzles which direct the jet streams are angularly adjustable and indexed together to (1) allow selection of an appropriate torque or couple based upon volume and pressure of fluid flow while (2) insuring that the high pressure jet reaction forces are always balanced, that is, when two nozzles are used, the forces are essentially equal and opposite along parallel lines.

The tool may be of such small size as to be inserted into the hollow structures through small openings and hung, pulled or otherwise supported and moved therein to enable jet stream cleaning of entire inner surfaces of the structures, particularly corners and other hard to reach areas. Such a tool, even though of sufficiently small size to fit through an eight inch diameter opening, may be provided from a hose connected thereto with sufficient volume of fluid such as water under high pressure and in multiple small diameter streams which are automatically redirected in overlapping three-dimensional patterns to clean or decontaminate the entire interior wall and other exposed interior surfaces of conduits, cleaning tanks, vessels, autoclaves, reactors or other similar hollow structures. The removed material is typically carried away by the flowing stream of spent cleaning fluid.

While the device is well suited to cleaning of interior surfaces, its three-dimensional pattern of coverage may also be useful for cleaning external or other surfaces, including latticework or similar structures such as those with irregular contours or textures, where the best cleaning results may be achieved by providing a means of directing high pressure jet streams to such surface from both a variety of positions and a variety of angles so as to minimize the loss of coverage in surface areas, such as concavities, which may otherwise inaccessible to a direct jet stream, or any area in which "shadows" in the jet stream coverage pattern may result from the jet stream being blocked by a portion of the structure to be cleaned.

It is an object of the present invention to provide a small multi-nozzle fluid jet stream apparatus having improved speed control for cleaning interior surfaces of hollow structures by automatically scanning large areas of such interior surfaces with high pressure jet streams having multiple crossing patterns to uniformly expose all portions of such areas to adequate and uniform cleaning action.

Another object of the invention is to provide selectable adjustment to utilize forces derived from the fluid jet streams of a cleaning nozzle structure within a hollow structure to uniformly and efficiently redirect the jet streams to provide a uniform three-dimensional scanning pattern for cleaning using a wide range of combinations of pressure and flow rates.

A further object of the invention is to provide a nozzle tool having multiple jet nozzles aimable in many directions for cleaning the interior of a hollow structure and which can be hung or suspended centrally at the interior of the structure and which will redirect the nozzles to scan the interior of the structure without greatly affecting the position of the apparatus as the direction of the jets change.

Another object of the invention is to provide a simple easily accessible manual adjustment to vary a reactive torque or coupled force of a pair of oppositely directed fluid jet streams to optimally change the speed of three-dimensional scanning pattern of the jet streams for cleaning the interior of hollow structures based on dimensions and condition of surfaces being cleaned and on pressure and flow rates available from any given fluid sources.

Another object of the invention is to provide a cleaning tool meeting any of the foregoing objects and which is selectively adjustable before a cleaning operation to provide a selected three-dimensional cleaning pattern.

Another object of the invention is to provide a cleaning tool meeting any of the foregoing objects and in which adjustable jet stream nozzles are indexed together to provide essentially identical positional adjustment for the respective nozzles to insure that the jet reactive forces are balanced so that the combined reactive forces are equal and opposite to impart only rotational movement to a rotating portion of the tool.

A further object of the invention is to provide cleaning tool in which variations in nozzle orientation and variations in supply pressure and quantity of a cleaning fluid can be preselected to provide an optimum cleaning action in a desired cleaning pattern.

Another object of the invention is to provide in the nozzle tool a simple and convenient means to facilitate inspection and replacement of rotating parts and high pressure seals.

Another object of the invention is to provide in a three-dimensional automatically-omnidirectional nozzle tool a self-regulating rotational speed control utilizing a viscous liquid which not only lubricates bearings but also provides a torque drag for speed control due to internal viscous shear as it flows between two relatively moving parts.

It is also an object of the present to provide a small multi-nozzle fluid jet stream apparatus having a three dimensional dispersion pattern so that jet streams may be directed to impinge upon an irregular structure or surface at both a variety of positions and a variety of angles in order to maximize the amount of such surface or structure which may be exposed to the direct jet stream for cleaning.

To achieve these objects the invention comprises two relatively movable principal support assemblies. One is a main fluid input assembly in which a relatively stationary main tubular body internally supports with viscous dampening a rotatable hollow coaxial fluid input main shaft. The main shaft supports a transverse shaft assembly forming a continuation of the fluid path leading to a pair of oppositely directed nozzles on a rotatable cross body which is rotated by jet reaction of the fluid issuing from the nozzles. The stationary tubular body and the rotatable cross body have mutually perpendicular axes and carry mutually engaged bevel gears. Rotation of the cross body on the transverse shaft is resisted by the engaged bevel gears, thus tending to cause the direction of the transverse shaft's axis to change in a plane perpendicular to the main shaft axis. This change of direction is subject to a torque drag of a viscous liquid between two closely spaced surfaces of the stationary main tubular body and the fluid input main shaft. Changes in nozzle size, nozzle orientation, fluid flow rate and pump pressure for the jet fluid can be accommodated to select various operating parameters of the cleaning nozzle tool enabling an optimum essentially omnidirectional or spherical pattern of crossed paths of jet streams.

DESCRIPTION OF THE DRAWINGS

FIG. 10 is a table showing a nozzle tip sizes which may be used with the present invention to achieve operation in part of the operating range of nozzle rotating speeds at different flow rates and fluid pressures.

DESCRIPTION OF THE PREFERRED EMBODIMENT

Figure 1:
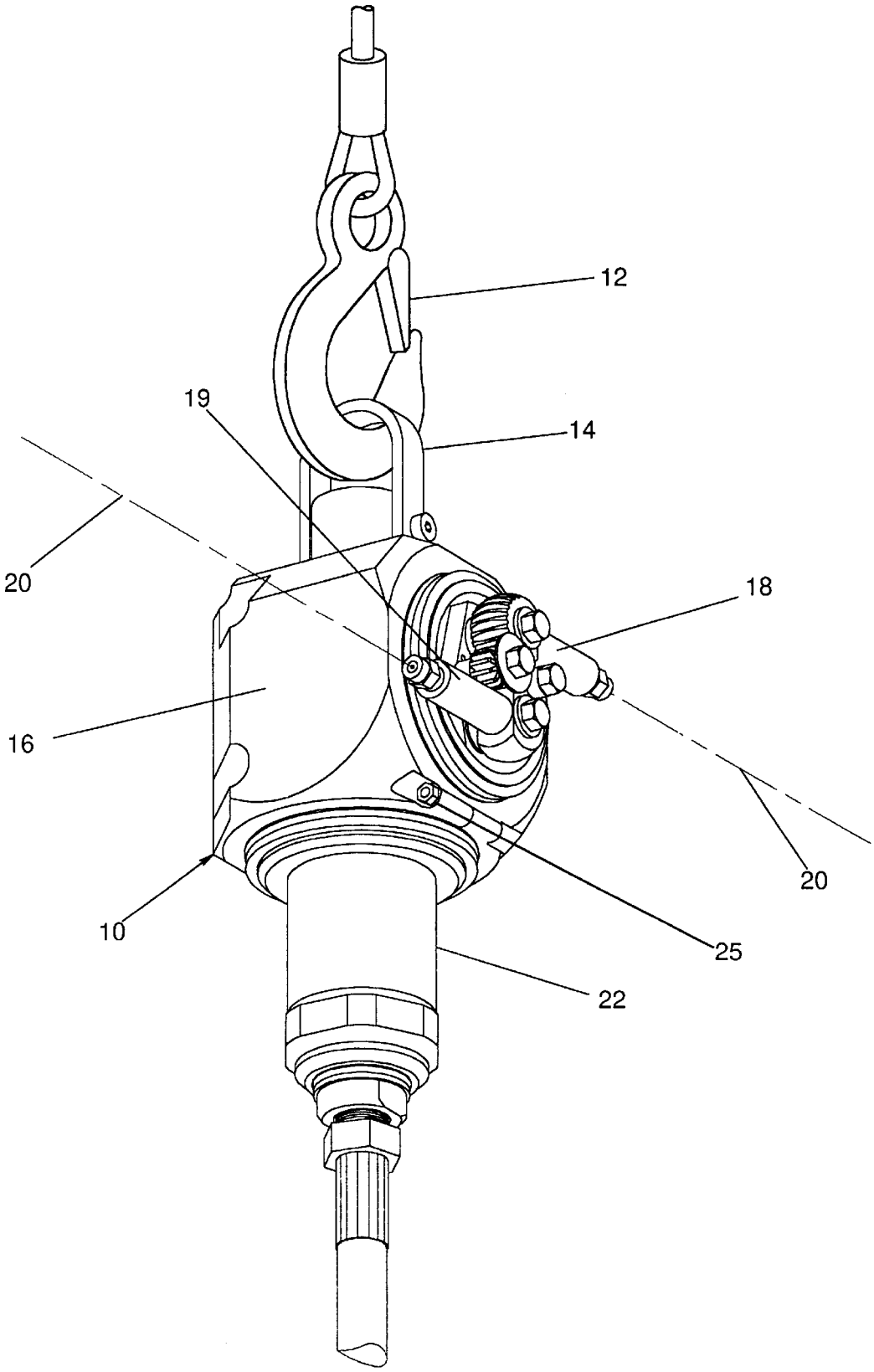
FIG. 1 is a perspective view from beneath and to the side of a cleaning nozzle tool shown suspended on the lower end of a cable and supplied from beneath with high pressure cleaning fluid from a flexible hose.

As seen in FIG. 1, a waterjet cleaning tool 10 is supported from a vertically hanging cable 12 having a hook engaging an eye member 14 on the tool for freely rotatably supporting the tool for rotation about a vertical axis. The tool 10 comprises a housing 16 at its upper end rotatable about the vertical axis and having a pair of oppositely directed offset parallel banjo-shaped nipple or nozzle structures 18 and 19 from which issue parallel coplanar jet streams of water 20 for cleaning inner surfaces of hollow bodies upon which the jet streams impinge.

The banjo nipples 56 are indexed together by gear teeth through a pair of connecting gears to allow both nipples to be set at the same angle. The nipples 56 are capable of covering a range of 0 to 90 degrees. The positions of the arms are indicated by the number plate which has numbers from 0 to 9, corresponding to angles from 0 to 90 degrees. During assembly of the device, the nipples 56 are indexed so that the jets are parallel and opposite to each other so that the tool 10 will achieve smooth and balanced rotation.

The lower end of the tool 10 as shown in FIG. 1 is a relatively stationary body 22 having depending inlet means for connecting it to a source of high pressure water or other cleaning fluid to supply the jet nozzles 18 and 19. While FIG. 1 shows the tool suspended with a generally vertical orientation by eye 14 attached to a flexible support, the tool may be operated or supported in any orientation and may be supported by the hose or other structure which supplies fluid to the tool. The tool may be mounted on a rigid arm for cantilevered support as the tool is moved, for example, through a horizontal pipe.

Figure 2:
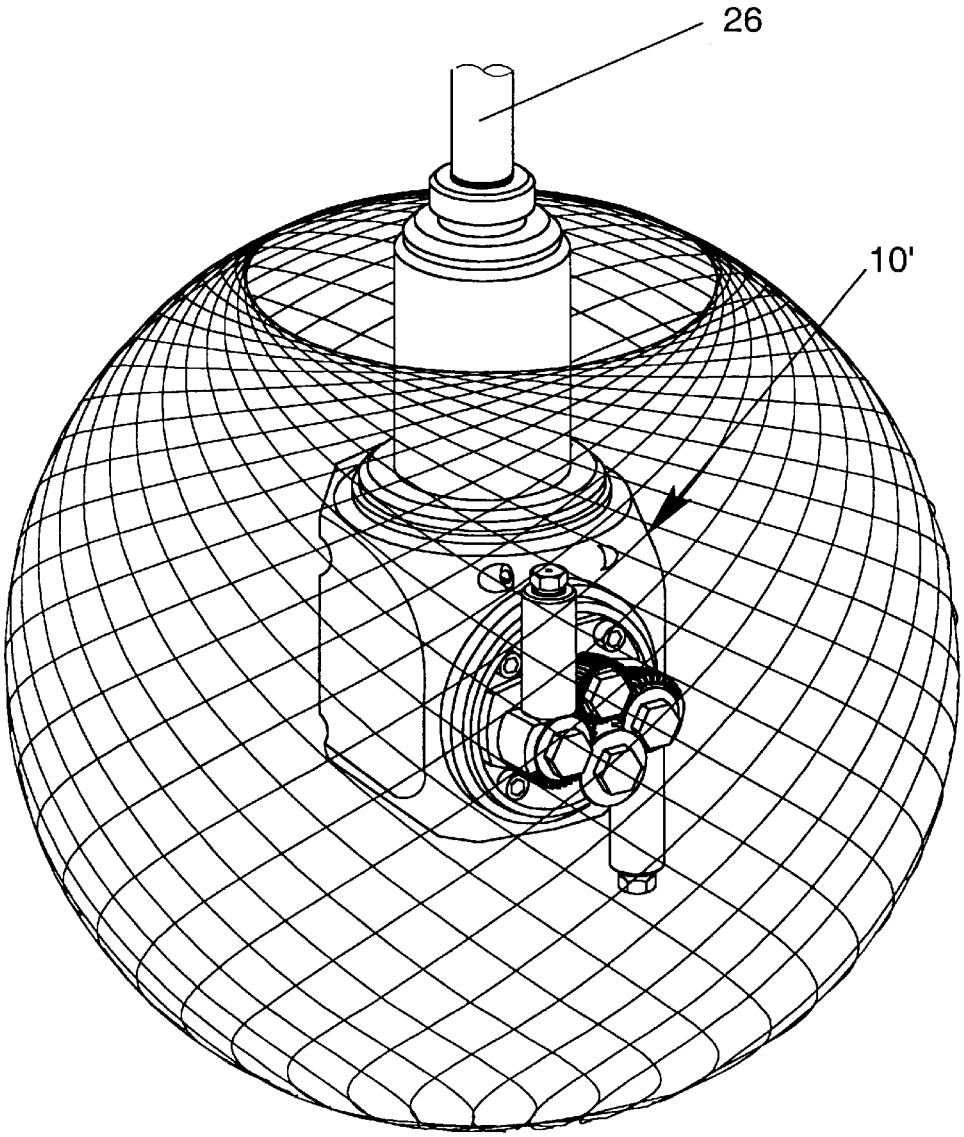
FIG. 2 is a perspective view from above and to the side of a modified cleaning nozzle tool shown suspended on the lower end of a flexible hose which supplies high pressure cleaning fluid to the nozzle and illustrating a generally spherical pattern of crossed paths of cleaning jet streams occurring during operation of the tool.

The water jet nozzle devices 18 and 19 are selectively adjustable so that the distance between the nozzle axes may be changed as described later in connection with FIG. 7. The axes of the adjusted relatively fixed nozzles remain parallel during use, but their directions are continuously changed as the banjo nozzle support member 24 which supports the parallel banjo nozzles 18 and 19 is rotated about a horizontal axis within the housing 16 in response to the reaction forces from the jet streams. The housing 16 is formed of two cup-like members secured edge-to-edge at a plane containing the aforementioned vertical and horizontal rotational axes of the tool by four bolts 25 as in FIG. 1 and through bolt holes 25*h* in FIG. 3. A gear mechanism, to be described later, within the housing 16 utilizes rotating action of the banjo nozzle support member 24 to automatically cause rotation of the housing 16 so that the direction of the horizontal axis of the banjo nozzle support member 24 is progressively changed in a horizontal plane to provide means whereby the progressive movement of the jet streams 20 will define an essentially omnidirectional 360° three-dimensional jet scanning pattern which would essentially cover an inner spherical surface as suggested by FIG. 2 which shows a similar water jet cleaning tool 10'. The jet cleaning tool 10' as seen in FIG. 2 is essentially the same as in FIG. 1, but the housing 16 is omitted and the tool is inverted with respect to FIG. 1 and is shown suspended for cleaning use by means of a flexible high pressure water supply line 26.

As seen in FIGS. 3–6, a support means subassembly of the tool 10 which is fixed to the input high pressure water line and relatively stationary during rotation of the nozzles 18 and 19 in use of the tool comprises the stationary main cylindrical body 22 with an inlet connector nut 30 threaded into one end until a shoulder on the nut abuts the outer end of the main body 22 and a cup-shaped bevel gear member 32, having an outwardly facing set of sixty three gear teeth 34, secured to the other end of the body 22 by bolts 36. The nut 30 has an exposed female thread to receive a conventional coupling connector on a hose from a high pressure fluid source.

The inlet nut 30 may be easily removed for inspection of the parts of the adjacent high pressure seal assembly 43*a* and for replenishment of the viscous fluid when this end of the tool is pointed upwardly. Filling with viscous fluid requires removal of the plug screw 69 in a hole 69' to permit escape of excess material as the inlet nut 30 is screwed tightly against the end of the main body 22 after which the plug is reinserted.

Figure 3:
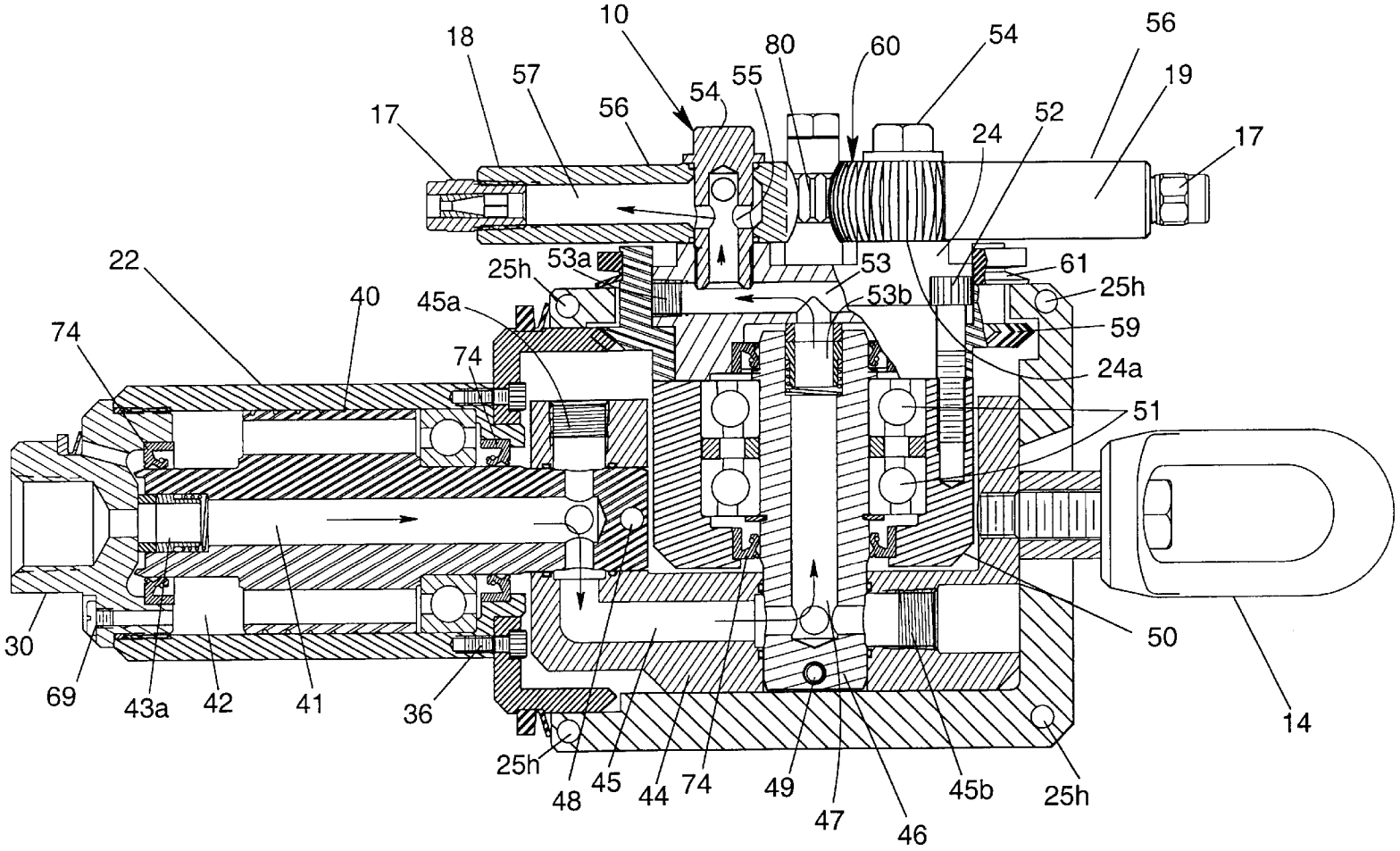
FIG. 3 is essentially a longitudinal section of the nozzle apparatus of FIG. 1 taken at a plane containing mutually perpendicular axes of a longitudinal main supporting shaft and a transverse supporting shaft, but showing parts of the structure non-sectioned for better illustration.

As seen in FIG. 3, a second support means subassembly is rotatable with respect to the main body 22 and provides three sealed interconnected high pressure fluid passages 41, 45 and 47 carrying fluid from an inlet passage in inlet nut 30 to an outlet passage at the banjo nozzle support member 24 carrying nozzles 18–19. This second subassembly comprises: a main shaft 40 coaxially journalled in the main body 22 for rotation about a longitudinal axis by ball bearings 42 and having a coaxial central passage 41, a U-shaped angle block 44 having an L-shaped passage 45, and a cross shaft 46 having a coaxial central passage 47. The downstream end of passage 41 and the upstream end of passage 47 terminate short of the ends of the respective ends of shafts 40 and 46. These latter ends of shafts 40 and 46 are firmly secured by removable pin members 48 and 49 in two respective mutually perpendicular short and long wall portions of the U-shaped angle block 44. The L-shaped passage 45 is formed by two intersecting bores in these respective short and long wall portions. The ends of the L-shaped passage are sealed by removable screw plugs 45*a* and 45*b*. At the downstream end of passage 41 in shaft 40 and at the upstream end of passage 47 in shaft 46 these shafts have crossed transverse passages connecting passages 41 and 47 with passage 45 to enable continuous flow of fluid through this second subassembly. At opposite sides of the transverse passages the outer surfaces of the shafts 40 and 46 are sealed to the walls of the block 44 by O-ring seals.

Figure 6:
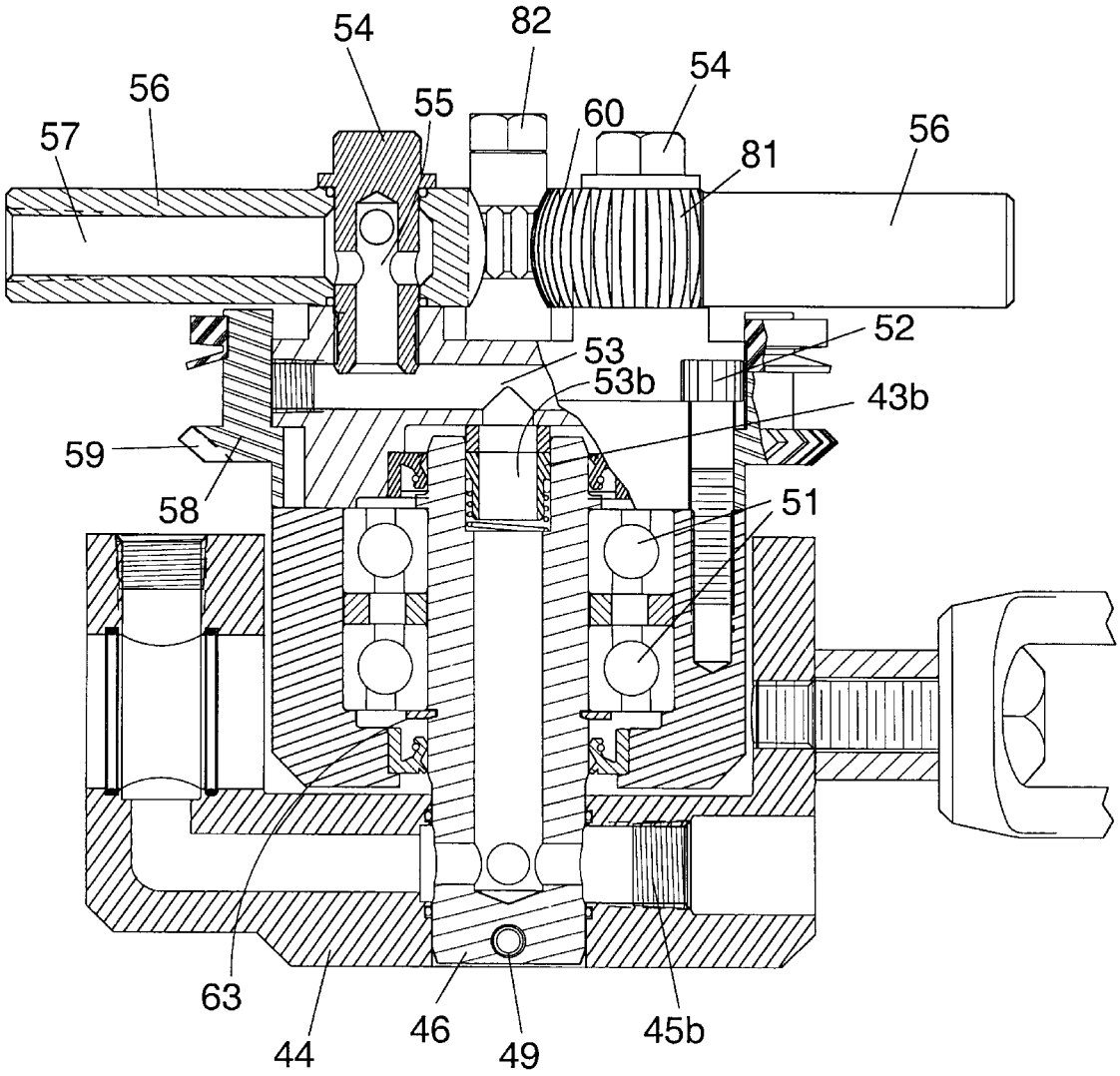
FIG. 6 is a cross body subassembly to be secured to the end of the longitudinal main supporting shaft of the tool of FIG. 3 and showing details of rotatable nozzles and a gear rotatably supported on the transverse supporting shaft.

A third subassembly is rotatably mounted coaxially on the cross shaft 46 for rotation about an axis perpendicular to the axis of shaft 40 and provides three sealed interconnected high pressure fluid passages 53, 55 and 57 carrying fluid from the passage 47 in cross shaft 46 to the replaceable nozzle discharge tips 17 of nozzles 18–19. This third subassembly comprises: a cup-shaped cross body 50 coaxially journalled on the cross shaft 46 by a set of ball bearings 51 and capped at its upper open end as seen in FIGS. 3 and 6 by the banjo nozzle support member 24 which is secured thereto by four bolts 52 as seen in FIGS. 3, 6 and 7. The set of bearings 51 fits precisely between internal shoulders on the cross body member 50 and the nozzle support member 24 when these members are secured together by the bolts 52. The inner race of the upper bearing is held against a shoulder on the cross shaft 46 by means of a resilient snap ring 63, identified in FIG. 6, engaging the bottom of the inner race of the lower bearing. The snap ring is secured in an external annular groove in the cross shaft 46. The spacial area around the bearings 51 and within the cross body 50 is sealed at opposite ends by two similar shaft seals 74. At one end of the spacial area the seal 74 extends radially between the cross shaft 46 and a portion of the support member 24. At the other end the seal 74 extends between the cross shaft 46 and a lower portion of the cross body 50.

Removal of the bolts 52 enables easy removal of the nozzles 18–19 and their supporting member 24 to facilitate inspection of the parts of the high pressure seal assembly 43*b* adjacent the central opening in the member 24.

The banjo nozzle support member 24 has a transverse passage 53 bored almost all the way across the nozzle support member 24. The entry end of this bore is sealed by a removable screw plug 53*a*. A central opening 53*b* at the lower face of the nozzle support member 24 provides fluid passage between the cross shaft passage 47 and banjo nozzle support member passage 53. The enlarged round ends or heads of the banjo-shaped nozzle devices 18 and 19 have opposed flattened parallel surfaces 60 by which they are releasably clamped to top flat faces of raised portions 24*a* of the nozzle support member 24 by hollow banjo bolts 54 permitting rotational adjustment of these heads on parallel axes perpendicular to surfaces 60 and through the centers of these heads. The central passages 55 of the banjo bolts 54 extend into communication with the passage 53 in the nozzle support member 24. Passages 57 extend from within the enlarged round flattened head ends of the banjo-shaped nozzle devices 18 and 19 to the ends of the necks or nipples of these devices in which are threaded removable nozzle tip members 17 from which the jet streams 20 are discharged. The banjo bolts 54 have plural transverse holes interconnecting passages 55 and 57 with bolt-encircling O-rings at opposite sides of these holes to seal the passages 57 at the surfaces 60 and at the faces of raised portions 24*a*.

Figure 7:
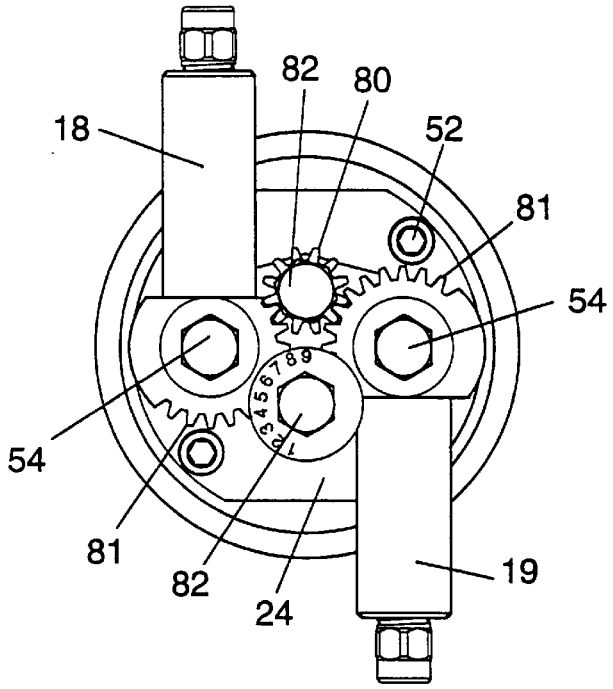
FIG. 7 is a view in the direction of the axis of the transverse supporting shaft of FIGS. 3 and 6 and showing an adjusted offset relationship of two oppositely directed banjo nozzles.
Figure 8:
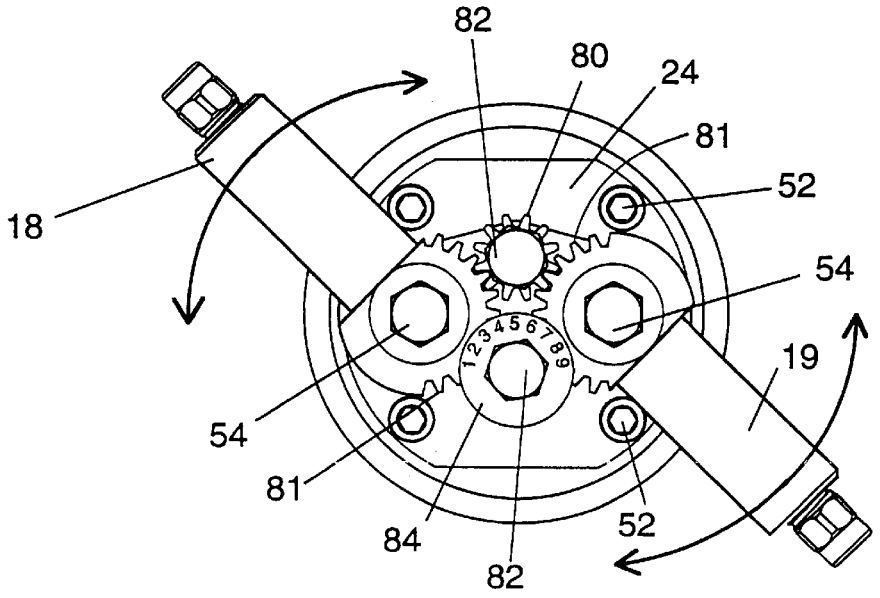
FIG. 8 is a view similar to FIG. 7 showing another adjusted offset relationship of the two oppositely directed banjo nozzles.

As seen in FIGS. 3, 6, 7 and 8, the enlarged round ends of the banjo-shaped nozzle structures 18 and 19 have external gear teeth 81 extending between the opposed flattened parallel surfaces 60. These gear teeth engage the teeth of a pair of spaced smaller diameter idler gears 80 which rotate freely during relative adjustment of the nozzles on bolts 82 screwed into the banjo nozzle support member 24 at opposite sides of the enlarged ends of the nozzle structures. These engaged teeth provide means to keep the necks of the banjo-shaped nozzle devices 18 and 19 parallel so that the axes of the two nozzles are always the same distance from the center of the support member 24. The nozzles may be selectively manually adjusted over an angular range of approximately 90° before using the tool. During use the nozzles are clamped against rotation in the desired selected position by tightening banjo bolts 54 and idler gear bolts 82 in nozzle support member 24. An indexing disk 84 fixed to the top of one of idler gears as seen in FIGS. 7–8 has inscribed numbers 0 through 9 to indicate the relative angular positions of the nozzles and the distance between their axes. When number 0 is on a line between the centers of the idler gears 80 the nozzle axes are in their closest positions. Mid-range adjusted spacing is at number 5 as seen in FIG. 8. Maximum spacing of the axes is at number 9 as seen in FIG. 7. Any reaction force created by the water jets 20 therefore is a couple force about the axis of cross shaft 46 which merely tries to rotate the nozzles 18–19 and their support member 24 as a unit.

In all angularly adjusted and operating positions of the oppositely directed parallel nozzle devices 18 and 19, the longitudinal axes of these nozzle devices remain directed in a common plane perpendicular to the axis of rotation of the support member 24 which rotates coaxially on cross shaft 46. Parallel jet streams 20 issuing from the tips 17 of these nozzle devices are discharged into this same common plane in the directions of the respective nozzle axes. The transverse pivot axes for angular adjustment of the nozzle devices on the banjo bolts 54 are parallel to and equally spaced from the axis of shaft 46 so that in all angularly adjusted positions of the nozzle devices in their common plane, the nozzle device longitudinal axes and the directions of the jet streams 20 remain parallel and equally spaced from the axis of shaft 46.

As seen in FIGS. 3 and 6 the third subassembly also includes a bevel gear 58 clamped between the cross body 50 and the banjo nozzle support member 24. This gear 58 has seventy-three downwardly and outwardly facing beveled teeth 59 which mesh with the teeth 34 of gear 32. As seen in FIG. 3, the gears 32 and 58 have annular external recesses which retain resilient seals 61 between these gears and faces of the housing 16. The seals have resilient lips in contact with these faces which keep contaminants from entering the interior of the housing 16. Bevel gear members 32 and 58 may be constructed from a variety of suitable materials having adequate durability and resistance to corrosion. Such materials would include, for example, stainless steel, brass, and acetal plastic commonly sold under the trademark "DELRIN."

Figure 5:
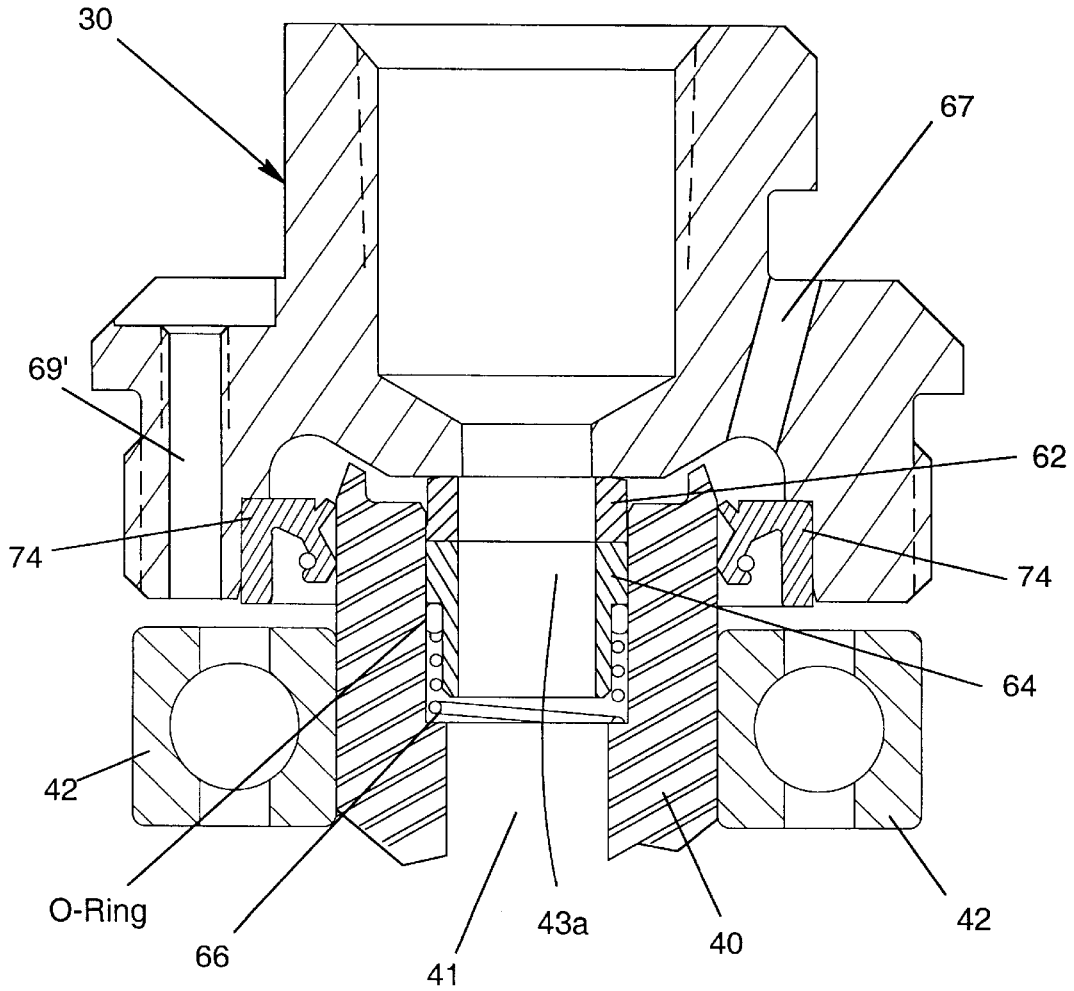
FIG. 5 is a section showing greater detail of a high pressure seal at the left end of the longitudinal main supporting shaft of FIGS. 3 and 4.

The passages 41 and 47 in the main shaft 40 and the cross shaft 46 are counterbored at the ends near the central openings in the inlet nut 30 and the nozzle support member 24 to receive the same type of high pressure seals around these openings. FIG. 5 shows more clearly this type of high pressure seal for the sealing means between the shaft 40 and nut 30. Each seal comprises a cylindrical carbide seat 62 with smooth flat end faces, one face abutting a smooth surface around the respective central opening and the other face being engaged by a flat smooth end face at one end of a coaxial seal member 64. Each seal member 64 has a neck of reduced diameter near its other end to fit inside and accommodate a compression spring 66 which holds seal 64 and seat 62 against the face of nut 32 to seal at low pressure. An O-ring seals against an outer shoulder formed by the neck on the seal member 64 and tightly between the cylindrical surfaces of the neck of seal member 64 and the passage 41 counterbore.

A plurality of weep passages 67, covered by a protective cover seal 68 to permit safe escape of high pressure fluids in the event of failure of the high pressure seal at the left end of passage 41 as seen in FIGS. 34.

Figure 4:
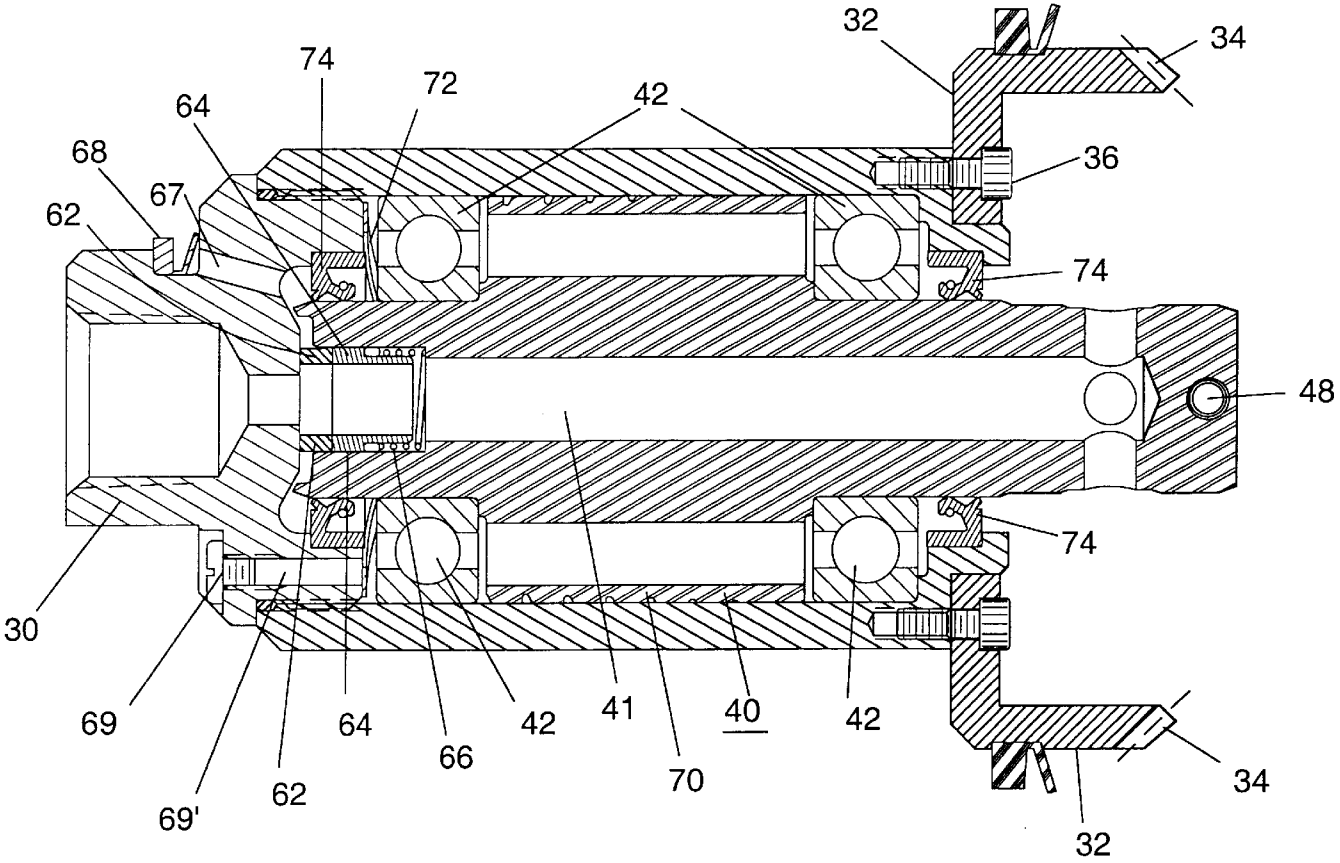
FIG. 4 is a main body subassembly of the tool of FIG. 3 showing details of a viscously dampened rotatable longitudinal main supporting shaft.

As seen in FIGS. 3 and 4 the main shaft 40 is precisely located radially within the main body 22 by means of the bearings 42 which have outer races fitting closely within an inner cylindrical surface of the main body 22. Along the length of the main shaft 40 there is a central portion 70 of enlarged diameter with a long cylindrical outer surface and stepped end faces. The outer races of the bearings are spaced from the end faces of portion 70 while a flat wave spring 72, held in compression between an inner end face of the inlet nut 30 and one of the bearings 42, holds the inner races of the ball bearings 42 in engagement with inner stepped shoulders at the opposite end faces of the large diameter portion 70 of shaft 40 and also holds the outer race of the other bearing 42 against an inner shoulder on the body 22 near the gear 30 to precisely locate the main shaft 40 axially in the main body 22.

The spacial area around the bearings 42 and within the main body 22 is sealed at opposite ends by two similar shaft seals 74. At one end of the spacial area the seal 74 extends radially between the shaft 40 and a portion of the inlet nut 30. At the other end the seal 74 extends between the shaft 40 and a cylindrical portion of the body 22 which is of reduced diameter to fit within and coaxially locate the gear 32 with respect to the main body 22.

The outer cylindrical surface of the central portion 70 of the shaft 40 has a helical groove extending from one end face to the other. This helical groove is of progressively decreasing cross section in the direction away from the inlet nut 30. When water is being discharged from the nozzles 18 and 19 a reactive force from the jet streams causing counterclockwise rotation of the nozzles 18–19 and nozzle support member 24, as seen in FIG. 7, to similarly rotate the bevel gear 58. Gear 58 is meshed with gear 32 which is driven to rotate the main body 22 clockwise as seen from the left or outer end in FIGS. 3 and 4.

All void spaces in the chamber formed between the seals 74 at opposite sides of the bearings 42 are filled with a viscous liquid which lubricates the relatively moving parts in the confined area between the seals 74 and also functions, when pumped by the helical groove in the outer surface of the main shaft 40 between the shaft 40 and the main body 22, as a built-in torque governor means to control the rotational speed of the nozzles around the axis of the cross shaft 46. The rotational speed of the housing 16 around the axis of the main shaft 40 is slightly more due to the greater number of teeth on bevel gear 58 compared to the number of teeth on mating bevel gear 32.

The direction of the helical groove on the cylindrical surface of the central portion 70 of shaft 40 is like a right hand thread and is such that the above-mentioned clockwise rotation of the main body 22 moves the viscous liquid from left to right between the main shaft 40 and main body 22 as seen in FIGS. 3 and 4.

The central portion 70 of main shaft 40 has a plurality of circumferentially spaced bores uniformly spaced about the axis of shaft 40 and extending through its length of the portion 70. These bores increase the capacity of the chamber which contains the viscous liquid and provide return passages for the flow of viscous fluid conveyed by the helical groove.

The viscous liquid may have different viscosities such as 500, 2,000 or 12,500 centistokes. It may be a silicone material. A suitable viscous material is polydimethylsiloxane (inhibited) available under a product designation L-405 from OSi Specialties, Inc., in Danbury Conn.

The tool may have a wide range of operating rotational speed of the nozzles around the axis of the cross shaft 46, preferably about 5 to 50 rpm. The reaction force produced by the jet streams 20 may be varied over a wide range such as 40 to 90 in-lb of torque based on pump pressure, flow rate, nozzle diameter and nozzle arm angles as correlated, for example, for a 20 to 30 rpm part of the speed range of nozzle operation in the table of FIG. 10.

The tool 10 is intended to provide rotation and jet stream dispersion on two axes, with one high pressure face seal for each axis. The device is capable of working pressures up to 12,000 psi and flow rates of 15 to 80 gpm. The wide range of flow rates is accommodated by two nozzle arms capable of being set at different angle offsets. Made from stainless steel, the unit is very rugged and compact.

It is desirable to insure that the torque produced by the jets is within the operating limits of the tool. The preferred tool operational torque range is from 40 to 90 in-lb and it is generally desirable not to exceed 100 In-lb of torque. The chart shown in FIG. 10 gives nozzle diameters and banjo nipple positions that will result in rotation speeds between 20 and 30 rpm at various pressures and flow rates.

The rotation speed of the tool can be increased by increasing the setting of the banjo nipples, or it can be decreased by decreasing the setting of the banjo nipples. To calculate the jet torque for the tool the following formula may be used:

$$\text{Torque}=T=0.0522\times\text{Sqrt}(P)\times Q\times R\times\text{Sine } O$$

where:

P is pressure at the nozzle (PSI)

Q is the flow in rate (gpm)

O is the jet angle from the axis of rotation (degree)

R is the jet offset from the axis, 0.975 in. for the toll of the preferred embodiment.

Example: 50 gpm at 8000 psi with nozzles offset 0.975 inches at an angle of 20 degrees.

$$T=0.0522\times\text{Sqrt } 8000\times 5033\ 0.975\times\text{Sine } 20=78 \text{ inch-lb}$$

The unit is filled with a thick fluid that resists shaft rotation. Speed control is maintained by internal viscous shear. The unit was designed for an operating rotation speed range of 5 to 50 rpm. The unit should not be allowed to rotate faster than 60 rpm.

The jet reaction force and nozzle arms are designed to produce from 40 to 90 in-lb of torque based on pump size (see section 5). Too small a torque may result in erratic rotation rates or be insufficient to start rotation. Too large a torque will exceed the ability of the tool to govern rotation speed and may cause heat buildup, rapid seal wear, and excessive rotation speeds. The tool should not generally be operated at torques above 100 In-lb.

The measured flow capacity of the tool is Cv=2.5. This means that at 25 gpm the pressure loss through the tool is 100 psi, while at 50 gpm the loss is 400 psi.

Figure 9:
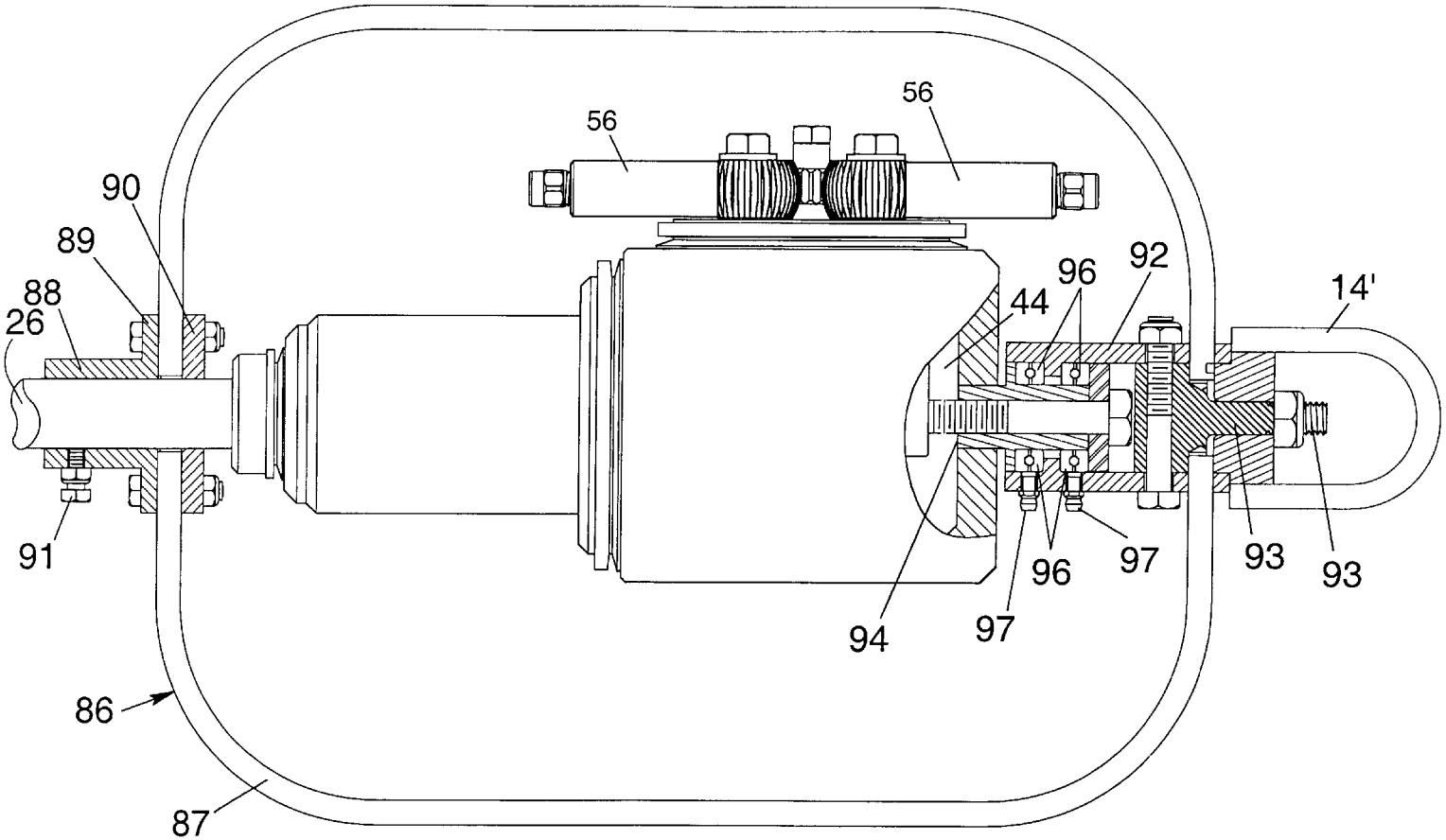
FIG. 9 illustrates a modification of the invention in which the waterjet cleaning tool is supported for rotation within a relatively stationary guide cage to protect the nozzles and rotatable components of the structure during use and to facilitate guiding the tool through a narrow pipe or opening to the location where the tool is to be operated.

FIG. 9 illustrates a modification of the invention in which the waterjet cleaning tool is supported for rotation within a relatively stationary cage 86 to protect the nozzles 18 and 19 and rotatable components of the structure during lowering of the tool into a hollow structure or into a vessel through a small opening, or while pulling the tool through an elongated passage being cleaned. During use of the device the cage may also provide the benefits in any orientation of the nozzle devices of (1) protecting the rotating parts from contact with a surface, (2) keeping the device sufficiently spaced from a surface during use to insure adequate spray coverage pattern over the surface, and (3) keeping the device centered within, for example, a pipe, in order to insure uniform spray coverage of the interior of the pipe.

The tool of FIG. 9 differs from that of FIG. 1 by the addition of a protective cage structure 86 rigidly interconnecting the water supply line 26' and an eye member 14'. The cage structure 86 completely enclosing the tool comprises a plurality of eight angularly spaced rigid U-shaped bar members 87. Each cage member 87 has a first end secured in a two-piece clamp coaxial with an inlet high pressure fluid line 26 line and comprising a tubular member 88 with an annular flange 89 and an annular clamping plate 90. The clamp is kept from turning on the inlet line by a set screw 91. The flange 89 and plate 90 may have radial grooves to better grip the cage members and are bolted together to anchor the first ends of the cage members 87. The other ends of the cage members 87 are similarly rigidly clamped in an annular support housing 92 between an annular end plate of the eye 14' and an enlarged flat head of a fastener 93 bolted to the housing 92 and having a threaded stem extending axially of the tool and passing through and secured to the end plate of the eye 14'. An axially extending structure 94 bolted to the end of angle block 4 and rotatable therewith is rotatably supported within the housing 92 by a set of thrust bearings 96 having lubricating fitting 97 in the wall of housing 92. The axial thrust bearings 96 provide less resistance to rotation of the nozzle apparatus when pulled axially by eye 14' than is provided by the means for attaching the eye 14 in FIG. 3 to pull the tool during its use.

Except as otherwise described, all components of the assemblies of the preferred embodiment herein are preferably made from a strong non-corrosive material such as stainless steel.

Other variations within the scope of this invention will be apparent from the described embodiments and it is intended that the present descriptions be illustrative of the inventive features encompassed by the appended claims.

What is claimed is:

1. A rotatable nozzle structure having means for rotatably supporting the nozzle structure about a rotational axis, said nozzle structure having a plurality of nozzle devices uniformly spaced around said rotational axis and at one location along said rotational axis, means for connecting each nozzle device to a common source of high pressure fluid to be discharged from the respective nozzle devices at the same pressure and flow rate, said nozzle devices being arranged to direct high pressure jet streams in a common plane perpendicular to said rotational axis and being similarly angularly oriented in their respective positions with respect to said rotational axis and of similar jet stream forming configuration to each apply a like jet-reaction force to said nozzle structure to rotate it in one direction about said rotational axis in response to fluid jet streams discharged from the nozzle devices, adjustable securing means for adjustably securing and releasably clamping each said nozzle device to said nozzle structure in an identified like position of annular orientation, said adjustable securing means including means for selectably pivotably adjusting the position of angular orientation of each nozzle device parallel to said common plane and about a pivot axis parallel to and uniformly spaced from said rotational axis to at least one other identified clamped position of angular orientation with respect to said rotational axis, with each such other clamped position being alike for all nozzle devices.

2. A rotatable nozzle structure according to claim 1 in which there are only two nozzle devices.

3. A rotatable nozzle structure according to claim 1 wherein said adjustable securing means includes means for mechanically interconnecting the nozzle devices so that during adjustment of said adjustable securing means said nozzle devices are similarly adjusted to like identified positions of orientation.

4. A rotatable nozzle structure according to claim 3 wherein said means for mechanically interconnecting the nozzle devices includes nozzle gear means on the nozzle devices and idler gears means meshing with the nozzle gear means.

5. A rotatable nozzle structure according to claim 4 wherein each nozzle device is banjo-shaped with a large flat head and a long hollow neck extending to a removable nozzle tip from which the jet stream issues, the nozzle devices being mounted for rotatable adjustment about parallel respective axes extending therethrough the centers of the flat banjo heads, said heads having gear teeth at their peripheries, and idler gear means interconnecting the gear teeth on the heads to provide like rotational adjustment of the nozzle devices when the angular orientation positions of the nozzle devices are changed.

6. A rotatable nozzle structure according to claim 1 wherein the adjustable securing means for selectably adjusting the nozzle devices is infinitely variable.

7. A rotatable nozzle structure according to claim 1 wherein the adjustable securing means for selectably adjusting the nozzle devices may be adjusted in plural discrete steps to different positions of nozzle orientation.

8. A rotatable nozzle structure according to claim 1 wherein the adjustable securing means for selectably adjusting the nozzle devices provides simultaneous like adjustment of the position of all nozzle devices.

9. A rotatable nozzle structure according to claim 1 including means to control rotational speed of said nozzle structure dependent on the adjusted angular positions of orientation of the nozzle devices and comprising two closely spaced surfaces relatively movably driven by means including said nozzle structure and having viscous liquid damping means subject to internal viscous shear between said closely spaced surfaces for retarding the rotation of the nozzle structure.

10. A cleaning tool movable along a longitudinal axis for cleaning an inner surface of an hollow object, a rotatable nozzle structure having first support means for rotatably supporting the nozzle structure on said tool for rotation relative to said tool about said longitudinal axis during a cleaning operation, said rotatable nozzle structure having second support means for rotatably supporting the nozzle structure on said first support means for rotation relative to said tool about another axis perpendicular to said longitudinal axis, said nozzle structure having a plurality of nozzle devices uniformly spaced around said other axis and at one location along said other axis, means for connecting each nozzle device to a common source of high pressure fluid to be discharged from the respective nozzles at the same pressure and flow rate, said nozzle devices being arranged to direct high pressure jet streams in a common plane perpendicular to said other axis and being similarly angularly oriented in their respective positions with respect to said other axis and of similar jet forming configuration to each apply a like jet-reaction torque to said nozzle structure to rotate it in one direction about said other axis in response to fluid jets discharged from the nozzle devices, adjustable securing means for adjustably securing and releasably clamping each said nozzle device to said nozzle structure in an identified like position of angular orientation, said adjustable securing means including means for selectably pivotably adjusting the position of angular orientation of each nozzle device parallel to said common plane and about a pivot axis parallel to and uniformly spaced from said other axis to at least one other identified clamped position of angular orientation with respect to said other axis, with each such other identified clamped position being alike for all nozzle devices, and means for mechanically interconnecting said first and second support means to cause rotation of said nozzle structure in response to said jet reaction to apply torque for rotating the nozzle structure about both said axes.

11. A rotatable nozzle structure according to claim 10 including means connected to part of said first support means to control rotational speed of said nozzle structure dependent on the adjusted angular positions of orientation of the nozzle devices and comprising two closely spaced surfaces relatively movably driven by means including said nozzle structure and having viscous liquid damping means subject to internal viscous shear between said closely spaced surfaces for retarding the rotation of the nozzle structure.

12. A rotatable nozzle structure according to claim 10 wherein said means for interconnecting said first and second support means includes gear means on said nozzle structure in engagement with relatively stationary gear means on said tool for rotating said second support means about said longitudinal axis.

13. A rotatable nozzle structure according to claim 10 wherein both said gear means include interengaged bevel gears coaxial with the respective longitudinal and perpendicular axes.

14. A cleaning tool in accordance with claim 10 wherein the first support means has a high pressure fluid passage having a first end rotatably connected to said input means and a second end rotatably connected to said nozzle structure, high pressure seal means at each end of said passage to seal the rotatable connection at the respective ends, and means to readily inspect the high pressure seal means at said first end by removing a portion of the input line and to readily inspect the high pressure seal at said second end by removing a part of said nozzle structure carrying the nozzle devices.

15. A cleaning tool in accordance with claim 10 including a relatively stationary cage structure completely enclosing said tool and said nozzle structure to protect the nozzle structure in any orientation thereof as said tool is moved axially through an object being cleaned, said cage being mounted on the tool to permit omnidirectional patterns of jet streams from said nozzle devices in any position of the tool.

16. A cleaning tool in accordance with claim 15 including relatively stationary means at one end of said tool for connecting said cage to an input line from a source of high pressure fluid, and relatively stationary means at the other end of said tool for connecting the cage to a pulling chain to pull the tool through an object being cleaned.

17. A cleaning tool movable along a longitudinal axis for cleaning an inner surface of a hollow object, a rotatable nozzle structure having first support means for rotatably supporting the nozzle structure on said tool for rotation relative to said tool about said longitudinal axis during a cleaning operation, said rotatable nozzle structure having second support means for rotatably supporting the nozzle structure on said first support means for rotation relative to said tool about another axis perpendicular to said longitudinal axis, said nozzle structure having a plurality of nozzle devices uniformly spaced around said other axis and at one location along said other axis, input means for connecting said tool to a common source of high pressure fluid to be discharged as high pressure jet streams from the respective nozzle devices at the same pressure and flow rate, said nozzle devices being similarly angularly oriented in their respective positions with respect to said other axis and of similar jet forming configuration to each apply a like jet-reaction torque to said nozzle structure to rotate it in one direction about said other axis in response to fluid jets discharged from the nozzle devices, adjustable securing means for adjustably securing each said nozzle device to said nozzle structure in an identified like position of orientation relative said other axis, said adjustable securing means including means for selectably adjusting the position of orientation of each nozzle device to at least one other identified position of orientation with respect to said other axis, with each such other position being alike for all nozzle devices, and means for mechanically interconnecting said first and second support means to cause rotation of said nozzle structure in response to said jet reaction to apply torque for rotating the nozzle structure about both said axes, said first support means having a sealed high pressure fluid passage with a first end of said passage rotatably connected to said input means and a second end of said passage rotatably connected to said nozzle structure, high pressure seal means at each end of said passage to seal the rotatable connection at each respective end, said first support means having a first hollow tubular shaft enclosing a first portion of the passage and journalled in said tool for rotational movement about said longitudinal axis, said first support means having a second hollow tubular shaft extending transversely of said longitudinal axis and enclosing an outlet portion of the passage, said second shaft having means for journalling said nozzle structure on said second shaft for rotational movement about said other axis.

18. A cleaning tool in accordance with claim 17 wherein said first support means includes three principal members defining portions of said passage, said three principal members being said first shaft, said second shaft and an intermediate block member in which the outlet end of the first shaft and the inlet end of the second shaft are removably sealed and secured.

19. A cleaning tool in accordance with claim 17 wherein said first shaft has an outer cylindrical surface and said tool has a relatively stationary cylindrical inner surface closely spaced about said outer cylindrical shaft surface, means for providing a sealed chamber including the space between said cylindrical surfaces, a viscous liquid in said chamber and providing in combination with said cylindrical surfaces a means for damping the rotation of the first ;haft relative to the tool during high pressure jet stream cleaning with the tool.

20. A cleaning tool in accordance with claim 19 wherein each nozzle device is banjo-shaped with a large flat head and a long hollow neck extending to a removable nozzle tip from which the jet stream issues, means for mounting the nozzle devices for rotatable adjustment about parallel respective axes extending through centers of the flat banjo heads, said heads having gear teeth at their peripheries, and idler gear means interconnecting the gear teeth on the heads to provide like rotational adjustment of the nozzle devices when the angular orientation positions of the nozzle devices are changed.

21. A rotatable nozzle structure according to claim 1 including means to control rotational speed of said nozzle structure dependent on the adjusted angular positions of orientation of the nozzle devices and driven by means including said nozzle structure and having damping means for retarding the rotation of the nozzle structure.

* * * * *